United States Patent [19]

Heller

[11] Patent Number: 4,787,859

[45] Date of Patent: Nov. 29, 1988

[54] MOLDED COUPLER

[76] Inventor: Peter V. N. Heller, 213 Esplanade, San Clemente, Calif. 92672

[21] Appl. No.: 21,303

[22] Filed: Mar. 3, 1987

[51] Int. Cl.[4] ..... H01R 13/627

[52] U.S. Cl. ..... 439/352; 439/358

[58] Field of Search ..... 439/350, 352, 357, 358; 285/305, 308, 320, 321, 260

[56] References Cited

U.S. PATENT DOCUMENTS 3,179,738 4/1965 De Lyon ..... 439/350

3,543,219 11/1970 Pautrie ..... 439/358

4,284,313 8/1981 Anhalt ..... 439/350

*Primary Examiner*—John McQuade

[57] ABSTRACT

An integral, one piece molded coupler includes an inner member and a pair of surrounding half sleeves joined to each other and to the inner member by an integral H-shaped hinge. The half sleeve members are elastically pivotable about the molded hinge members with respect to the inner sleeve. The molded hinge members are elastically deformable and provide a clamping force which maintains the coupling engagement of the coupler.

18 Claims, 2 Drawing Sheets

MOLDED COUPLER

FIELD OF THE INVENTION

This invention relates generally to molded couplers but the type in which elements of a system are interconnected by removeable couplings such as fluid systems or electrical systems.

BACKGROUND OF THE INVENTION

Through the years, a number of systems have been created in which discrete system elements are integrated into a common interactive system. Such systems find their application in virtually every product art area and include, for example, pneumatic or other gas flow systems in which multiple lengths of tubing are utilized to interconnect the system elements. Similarly, electrical systems are generally comprised of a plurality of discrete subsystem elements which in turn are interconnected by multiple groups of electrical conductors. By further example, fluid systems transporting and processing liquid fluids generally utilize a plurality of hoses or tubes to interconnect the system elements. Initially, such systems were fabricated as complete units and the interconnections therebetween were accomplished by various clamping devices directed to securing the interconnection with little attention to a difficulty of disconnecting the interconnection. With increasing sophistication of system construction and increasing mass production of such systems, there arose a need for interconnect devices which facilitated secure connections that which also permitted easy removal or disconnect for system separation, repair etc. To meet this need in the art for disconnect operative connectors, a great number of connector structures have been provided. Wile the individual structures of such connectors vary considerably, they all may be said to fall within several general classifications. These classifications include snap-in connectors, expansion type connectors, and swivel or interlocking type connectors.

U.S. Pat. No. 3,305,254 sets forth a snap-in type connector in which a generally elongated connector defines an interior axial passage which in turn defines a pair of inwardly projecting resilient elements. To be connected segments define a reduced cross section region and the connection is accomplished by forcing the connecting elements through the interior passage of the connector such that the inwardly extending snap-in elements extend into the recesses of the to be connected elements and lock them in place. Another snap-in coupler is set forth in U.S. Pat. No. 1,449,034 and a similar structure is set forth in U.S. Pat. No. 2,752,726. While directed to different art areas, both of these Patents set forth essentially the same snap connector in which a ball and socket arrangement may be disconnectably coupled together by forcing the ball element into the socket. The socket receiving the ball element includes a slot which splits the socket element and the resilience of the socket member permits the socket element to expand and thereby receive and captivate the ball element.

U.S. Pat. No. 4,147,444 sets forth one of the many expanding type connectors in which a cylindrically shaped dowel defines a cylindrically shaped axially extended sleeve and an internal spreader therein operative to expand the cylindrical sleeve of the dowel. The cylindrical sleeve defines a slot which receives the spreader and defines tapering side edges. As the spreader is forced through the slot, the cylindrical sleeve is spread causing it to expand outwardly and exert a captivating force on its surrounding elements. U.S. Pat. No. 833,542 sets forth a bolt anchor in which a cylindrical sleeve is fabricated in two sections and defines a pair of inwardly tapered slots between the two elements. One of the elements is threaded internally to receive a bolt and a moveable cam is carried on the threaded portions. The bolt anchor is operative by threading a bolt through it such that the thread bearing cam is drawn through the tapered slot in the split sleeve causing the portions of the sleeve to be driven outwardly to create an expanding coupling force. U.S. Pat. No. 4,020,735 sets forth an alternate embodiment with an expansion bolt in which a split cylindrical member defines a central passage having a tapered cross section which is maximum at the two passage ends and constricted at the center of the passage. A pair of tapered cam elements are received within each of the tapered portions of the internal passage and are drawn together by the action of the bolt to force the sleeve members outwardly and create an expanding coupling force.

U.S. Pat. No. 4,311,405 sets forth a swivel connector of a type which pivotally connects a ball-like member to a rod-like member. The connector includes a coupler having a pair of sockets in which one of the sockets defines a ball seat adapted for receiving and confining a pivot-like ball therein and the other socket is adapted for receiving and capturing the end of a rod member. The coupler is slotted to permit enlargement of the sockets and enable insertion of the end of the rod-like member into one of the sockets and insertion of the ball-like link member into the bearing seat of the other socket. The connector further includes a sleeve adapted to be received over one end of the coupler and rotatable relative thereto to a final position in which the coupler is locked.

U.S. Pat. No. 4,388,012 sets forth a swivel connector assembly for connecting a member intended to be pivoted to a pivot element. The assembly includes two components, a socketed assembly and a retaining sleeve. The socketed assembly has a forward portion including a socket forming a bearing seat and a rearward portion having a cylindrically shaped socket. A slot which extends from a point forward of the bearing seat center to and through the rearward portion forms a bifurcated opposed socketed pair which may be separated to enlarge the bearing seat. The cylindrically shaped socket is assembled to a pivot ball member and a member to be pivoted. The sleeve is arranged to be axially slid over the socketed rearward portion to thereby maintain the assembly in assembled relation. A snap element is forced inward by the sleeve passing over it and snaps outwardly once the sleeve has passed to form a snap connection to captivate the sleeve.

While these and other connectors provided in the art have to some extent met the need in the art for connectors which are readily detachable, there remains a need in the art for a simple, easy to use connector which may be fabricated as a single molded part and which provides a convenient, easy to use connection system suitable for use in a variety of system types including pneumatic and other gas processing systems as well as liquid systems and electrical systems.

SUMMARY OF THE INVENTION

Accordingly, it is a general object of the present invention to provide an improved connector. It is a more a particular object of the present invention to provide an improved connector suitable for use in a variety of systems. It is a still more particular object of the present invention to provide an improved connector which is molded from a single molded part and which is suitable for easy operation.

In accordance with the invention, there is provided a coupler defining an internal member having means for connection to one of the to be connected elements and an external sleeve member configured in the same shape as the internal member and sized to surround the internal member. The external member is fabricated of two split portions having tapering sides so as to define a pair of slots extending inwardly from each end and terminating at a hinge structure. The external member is secured to the internal member by a pair of hinge structures which permit the external member to be opened or closed. A pair of inwardly extending projections formed on the outer edge of each split portion of the external member define tapered cam surfaces and grasping edges. The second to be connected element is forced between the inwardly extending projections driving the external member outward and permitting the coupling to the internal member. The resilience of the hinge structure forces the inwardly extending projections into the to be connected element to provide a grasping force to secure the connection.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
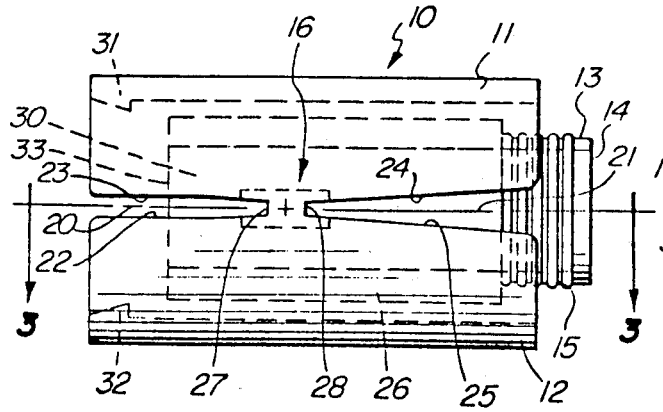
FIG. 1 is a side view of a cylindrical embodiment of the present invention molded coupler.

FIG. 1 sets forth a side view of the present invention coupler generally referenced by reference numeral 10 and comprising a pair of generally cylindrical half sleeves 11 and 12 and a generally cylindrical inner sleeve 26. The structure of inner sleeve 26 is set forth below in greater detail. However, suffice it to note here that inner sleeve 26 comprises a generally cylindrical member defining a center passage 30 extending axially through inner sleeve 26 and an end 33 at one end thereof and an end 14 at the other thereof. End 14 further defines an end fitting 13 comprising a generally cylindrical member having a reduced external dimension and defining a plurality of annular ribs 15. The function and structure of ribs 15 will be set forth below in greater detail. However, suffice it to note here that ribs 15 extend outwardly from the surface of end fitting 13 and encircle the outer surface thereof. Half sleeve 12 defines an inwardly extending edge 22 and a similar inwardly extending edge 25 which meet at a pair of vertical surfaces 27 and 28. The function of surfaces 27 and 28 is set forth below in greater detail. Half sleeve 12 further defines a similar pair of surfaces 37 and 47 (not shown) which are identical in structure to edge surfaces 22 and 25 respectively. Half sleeve 11 is essentially a mirror image of half sleeve 12 and comprises a generally cylindrical surface defining an edge 23 and an edge 24 extending inwardly and joined to surfaces 27 and 28 respectively. similarly, half sleeve 11 defines a second pair of edges 38 and 48 not seen in FIG. 1 but which are substantially identical to edges 23 and 24 respectively. Half sleeves 11 and 12 are mutually joined to a hinge 16 on one side and an identical hinge 17 (better seen in FIG. 2) on the side opposite to hinge 16. As will be set forth below in greater detail, the entire attachment of half sleeves 11 and 12 to inner sleeve 26 is accomplished by hinges 16 and 17.

Half sleeve 12 further defines an upwardly extending clasp rib 32 and half sleeve 11 defines a similar downwardly extending clasp rib 31. In the arrangement shown, half sleeves 11 and 12 are separated by four inwardly extending slots 20, 21 and a pair of identical slots 18 and 19 respectively on the opposite side of the coupler of FIG. 1.

Figure 2:
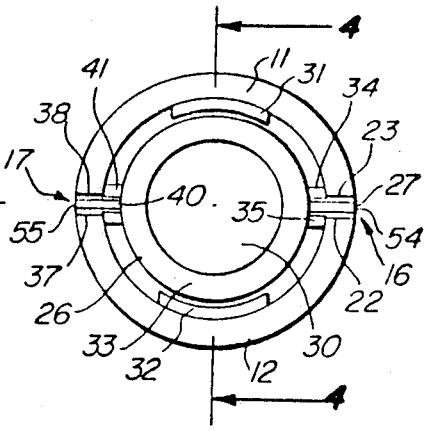
FIG. 2 is a rear side view of the present invention molded coupler.

FIG. 2 sets forth an end view of coupler 10 taken from the left side of coupler 10. As can be seen, half sleeves 11 and 12 form semi-cylindrical members which are joined at hinges 16 and 17 to cylindrical inner sleeve 26. It should also be noted and should be apparent to those skilled in the art that the center axis of inner sleeve 26 and the cylindrical combination of half sleeves 11 and 12 are coincident such that half sleeves 11 and 12 and inner sleeve 26 are concentric. The importance of this coincentricity is described below in greater detail. However, suffice it to note here that because of this concentric arrangement, coupling elements which are concentric with inner sleeve 26 are thereby also concentric with half sleeves 11 and 12. As mentioned above, half sleeves 11 and 12 define a pair of clasp ribs 31 and 32 respectively which, as can be seen in Figure 2, are also cylindrical in character.

Figure 5:
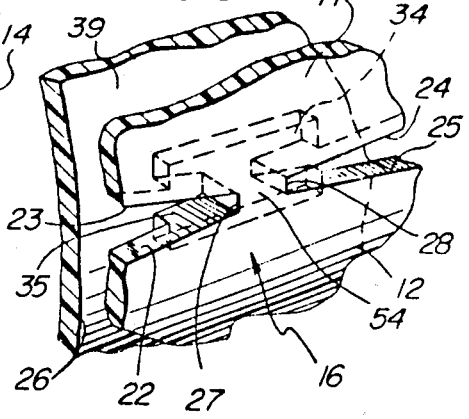
FIG. 5 is a partially sectioned perspective view of the hinge portion of the present invention coupler.

Hinge 16 comprises a hinge pivot 54, the structure of which is better seen in FIG. 5 but which, suffice it to note here, provides a continuous member joining half sleeves 11 and 12 to inner sleeve 26. Similarly, hinge 17 defines a hinge pivot 55 extending between and coupling half sleeves 11 and 12 to inner sleeve 26.

Simultaneous examination of FIGS. 1 and 2 shows that coupler 10 comprises a cylindrical member formed by inner sleeve 26 surrounded by a pair of cylindrical half sleeves 11 and 12 which are joined to inner sleeve 26 by a pair of inwardly extending integral hinges 16 and 17. In accordance with an important aspect of the present invention, hinges 16 and 17 define generally H-shaped hinges which, in accordance with an important aspect of the present invention, are molded in the molding fabrication process which produces coupler 10. Accordingly, half sleeves 11 and 12 may be pivoted about hinges 16 and 17 in either a coupling engagement which brings edges 24 and 25 closer together and which spreads edges 22 and 23 farther apart or in a second direction in which the converse occurs and edges 22 and 23 are brought closer together while edges 24 and 25 are separated. Accordingly, and as is set forth below in greater detail, coupler 10 may be forced open by squeezing half sleeves 11 and 12 together such that edges 24 and 25 are brought closer together thereby spreading and increasing the separation between clasp ribs 31 and 32. It should be noted that coupler 10 is, in its preferred form, molded of a resilient plastic material such that hinges 16 and 17 are resilient and under go elastic deformation during the foregoing described closure of edges 24 and 25 of half sleeves 11 and 12. Simply stated, clasp ribs 31 and 32 are forced apart to expose end 33 of inner sleeve 26 by squeezing half sleeves 11 and 12 together in the region of end 14 The elasticity and resilience of the material utilized in fabricating coupler 10 and thereby hinges 16 and 17 causes clasps 31 and 32 to be driven inwardly upon the release of the above-described pinching force such that coupler 10 returns to the configuration shown in FIG. 1.

Figure 3:
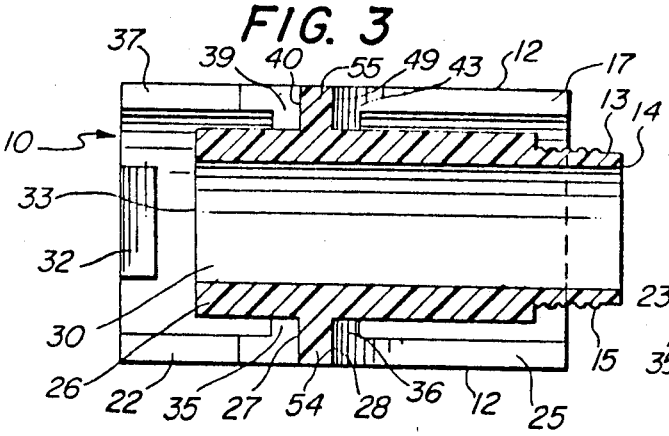
FIG. 3 is a section view of the coupler of FIG. 1 taken along Section lines 3—3 thereof.

FIG. 3 sets forth a section view of coupler 10 taken along section lines 3—3 in FIG. 1. As set forth above, half sleeve 12 defines a generally cylindrical member having a pair of edges 22 and 25 joined to hinge pivot 54 at upwardly extending surfaces 27 and 28. Similarly, half sleeve 12 defines a pair of surfaces 37 and 17 which are joined to hinge pivot 55 at a pair of surfaces 40 and 49 respectively. The structure of the present invention H hinge is set forth in greater detail in FIG. 5. However, suffice it to note here in conjunction with FIG. 3 that hinge pivot 54 and hinge pivot 55 of hinges 16 and 17 respectively form the center members of the present invention hinge structure. As will be set forth below in greater detail in conjunction with FIG. 5, hinge pivots 54 and 55 of hinges 16 and 17 form the center pivot points about which half sleeves 11 and 12 pivot with respect to inner sleeve 26 to accomplish the present invention coupling action. As should also be apparent in FIG. 3, center passage 30 extends continuously from end 33 to end 14 of inner sleeve 26. In essence therefore, inner sleeve 26 is in effect "suspended" within half sleeves 11 and 12.

FIG. 5 sets forth the details of hinge 16. It should be noted however that while the detail structure of hinge 16 is set forth in FIG. 5, the structure and function of hinge 17 of coupler 10 as well as hinger 97 and 98 of coupler 100 are substantially identical to hinge 16. Accordingly, the descriptions which follow of hinge 16 shall be understood to apply equally well to hinge 17 of coupler 10 and hinges 97 and 98 of coupler 100. Accordingly, and with reference again to Figure 5, hinge 16 forms the junction between inner sleeve 26 and half sleeves 11 and 12. Inner sleeve 26 defines an exterior surface 39. As also described above, half sleeves 11 and 12 are joined to hinge 16 at surfaces 27 and 28. A pair of hinge ribs 34 and 35 are defined in half sleeves 11 and 12 respectively and are generally parallel to each other and generally perpendicular to hinge pivot 54. Hinge ribs 34 and 35 are integral to surface 39 of inner sleeve 26 and half sleeves 11 and 12. Accordingly, hinge 16 comprises an H-shaped hinge structure which is integrally molded between half sleeves 11 and 12 and inner sleeve 26. In the operation of coupler 10, half sleeves 11 and 12 are elastically pivoted about hinge pivot 54 with respect to inner sleeve 26 by the elastic deformation of hinge 16. For example, when half sleeves 11 and 12 are pinched together such that edges 24 and 25 are driven closer together and edges 22 and 23 are separated by a greater distance, hinge ribs 34 and 35 are elastically deformed during the pivoting process such that each is in essence twisted by the pinching force applied to half sleeves 11 and 12. Because the material from which coupler 10 is molded is a resilient elastic material, hinge ribs 34 and 35 and hinge pivot 54 produce a counter acting spring force which tends to urge half sleeves 11 and 12 back to the generally parallel alignment shown in FIG. 1. Accordingly, the elastic deformation and elastic spring returning force provided by hinge 16 results in producing a spring-like closure force whenever hinge 16 is deformed as half sleeves 11 and 12 are pinched together. As will be apparent to those skilled in the art therefore, the dual action of hinge 16 in providing an integrally molded pivotal attachment between half sleeves 11 and 12 as well as a return spring for closure of coupler 10 eliminates the need for more complex and expensive hinge and spring biasing arrangements utilized in other couplers. It should also be noted, and those skilled in the art will appreciate the advantage resulting from the fact that the integral molding of hinge 16 to half sleeves 11 and 12 and inner sleeve 26 is facilitated in a single molding process whereby the entire assembly of coupler 10 may be produced in a single moding operation and further assembly and fabrication expenses an difficulties are avoided completely.

Figure 4:
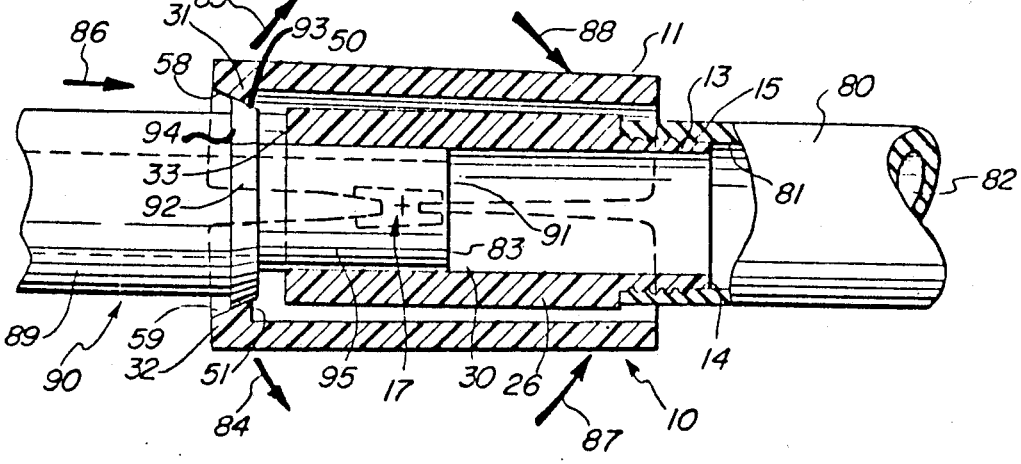
FIG. 4 is a section view of the present invention coupler taken along Section lines 4—4 in FIG. 2 and further including a pair of to be coupled tubing portions.

FIG. 4 sets forth a section view of coupler 10 taken along section lines 4—4 in FIG. 2 which depicts the process of joinging coupler 10 to a approiately configured fitting 90. Fitting 90 comprises a generally cylindrical member 89 terminating at one end in a reduced diameter cylindrical extension 95 having a generally planar end 91. In accordance with an important aspect of the present invention, extension 95 is configured and sized to be snuggly and sealingly received within inner passage 30 of coupler 10. It will be apparent to those skilled in the art that while a close precision fit between extension 95 and center passage 30 may achieve a sufficient seal for most applications, additional sealing force may be provided by utilizing any number of the commonly employed O ring seals between extension 95 and center passage 30 without departing from the spirit and scope of the present invention. Fitting 90 further defines an annular retaining ring 92 extending outwardly from extension 95 and joined to cylindrical member 89. In accordance with an important aspect of the present invention, retaining ring 92 defines an inclined or tapered camming surface 93 and a retaining edge 94.

In the position shown in FIG. 4, inner sleeve 26 of coupler 10 also supports a length of tubing 80 which may be fabricated of any number of plastic rubber or other flexible tubing structures and which defines an internal center passage 82 and an inner surface 81. Center passage 82 of tubing 80 is sized to be snuggly received upon and elastically fit over end fitting 13 of inner sleever 26 such that ribs 15 extend into and form a sealing engagement with inner surface 81.

In the position shown, fitting 90 is in the process of being inserted into and received within coupler 10. It should be noted that fitting 90 defines an interior center passage 83 which extends through extension 95 and cylindrical member 89 and is sealingly joined to the portion of the system in which coupler 10 is utilized and to which tubing 80 is to be joined. At the point of insertion shown in FIG. 4, the force exerted upon fitting 90 in the direction of arrow 86 which is intended to drive fitting 90 into coupler 10 results in forcing surface 93 against surfaces 58 and 59 of clasp ribs 31 and 32 respectively. The force imparted by inclined surface 93 against the similarly inclined surface 58 and 59 of clasp ribs 31 and 32 produces a spreading force in the direction of arrows 84 and 85 which tends to pivot half sleeves 11 and 12 about hinges 16 and 17 in a spreading-type action. This spreading action also results in driving the ends of half sleeves 11 and 12 remote from fitting 90 in a direction of closure shown by arrows 87 and 88. In other words, the force driving fitting 90 into coupler 10 produces a spreading of half sleeves 11 and 12 causing them to pivot about hinges 16 and 17. The pivoting of half sleeves 11 and 12 results in elastically deforming hinges 17 and 16 in accordance with the foregoing described hinge action. The continued insertion of fitting 90 into coupler 10 in the direction of arrow 86 continues to further separate clasp ribs 31 and 32 and further deform hinges 16 and 17 until retaininer ring 92 passes beyond surfaces 58 and 59 of clasp ribs 31 and 32. Thereafter, the absence of the spreading force between surface 93 and surface 58 and 59 permits half sleeves 11 and 12 to pivot in the opposite direction to that shown by arrows 84 and 85 and arrows 87 and 88 resulting in closure of coupler 10. As mentioned above and in accordance with an important aspect of the present invention, the returning force which provides closure of half sleeves 11 and 12 once fitting 90 has been inserted fully within coupler 10, is provided solely by the elastic deformation of hinges 16 and 17.

Figure 6:
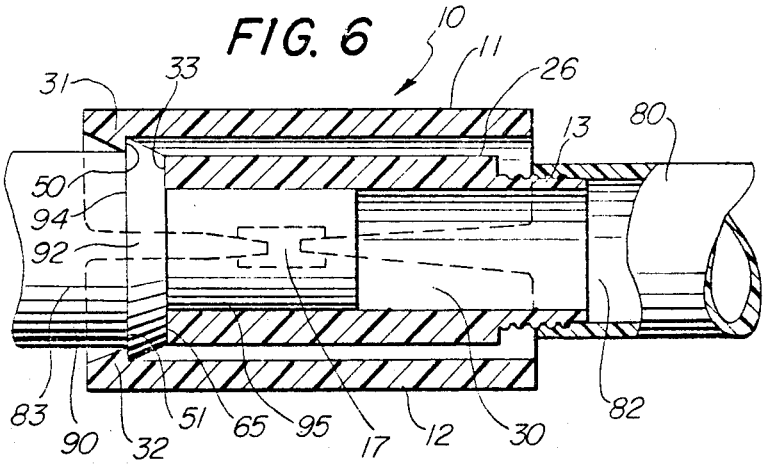
FIG. 6 is a section view of the present invention coupler taken along section lines 4—4 in the connected position.

Upon the elastic closure of coupler 10 due to the above-described resilient force provided by hinges 16 and 17, coupler 10 and fitting 90 assume the positions shown in the section view of FIG. 6. In the position shown, half sleeves 11 and 12 have returned to a substantially parallel concentric arrangement about inner sleeve 26. In accordance with an important aspect of the present invention, retaining ring 92 is captivated within coupler 10 by the grasping of clasp ribs 31 and 32 upon edge 94 of retaining ring 92. The inwardly extending surfaces 50 and 51 of clasp ribs 31 and 32 respectively abutt and grip edge 94 of retaining ring 92 and prevent withdrawl or separation of fitting 90 from coupler 10. The captivating action of clasp ribs 31 and 32 upon retaining ring 92 is maintained and secured by the resilient restoring force of hinges 16 and 17. As a result, a sealing coupling is provided between interior passage 83 of fitting 90, center passage 30 of inner sleeve 26 and center passage 82 of tubing 80. A a result, coupler 10 and fitting 90 cooperate to sealing couple fitting 90 to tubing 80.

The removal of fitting 90 from coupler 10 is provided by simply forcing half sleeves 11 and 12 together in the direction shown by arrows 87 and 88 in FIG. 4 which in turn pivots half sleeves 11 and 12 about hinges 16 and 17 causing clasp ribs 31 and 32 to be pivoted outwardly from retaining ring 92 and causing surfaces 50 and 51 to be removed from edge 94 of retaining ring 92 thereby releasing fitting 90 and permitting its withdrawl from coupler 10. As will be apparent to those skilled in the art, the above-described coupling and decoupling of fitting 90 and coupler 10 may be repeated to provide the connect/disconnect function of any number of systems such as fluid coupling systems utilizing liquids or gas under pressure or phenumatic systems and the like.

It will be apparent to those skilled in the art from the foregoing that any number of coupler types may be utilized in a variety of systems in which the present invention integral hinges are provided. For example, coupler 10 and fitting 90 may comprise any number of system elements to be connected and disconnected in accordance with system requirements. Coupler 10 and fitting 90, while shown in a fluid or liquid conduiting-type application may, without departing from the spirit and scope of the present invention, be utilized in fiber optic couplings, electrical couplings or virtually any system in which a connect/disconnect function is desired.

Figure 7:
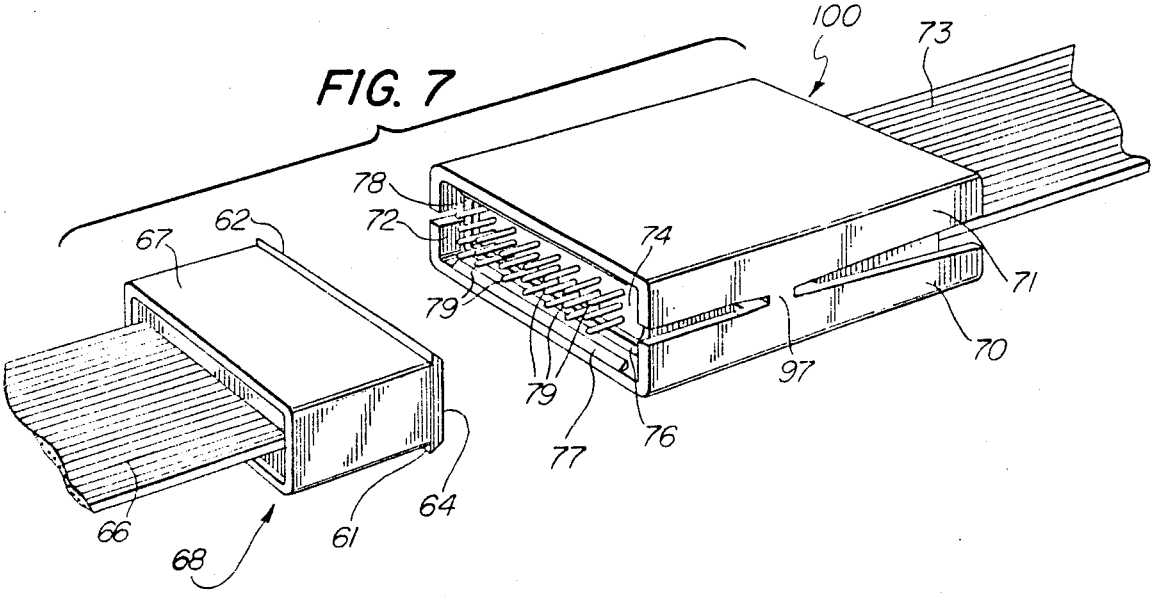
FIG. 7 is a perspective view of an alternate embodiment of the present invention coupler.
Figure 8:
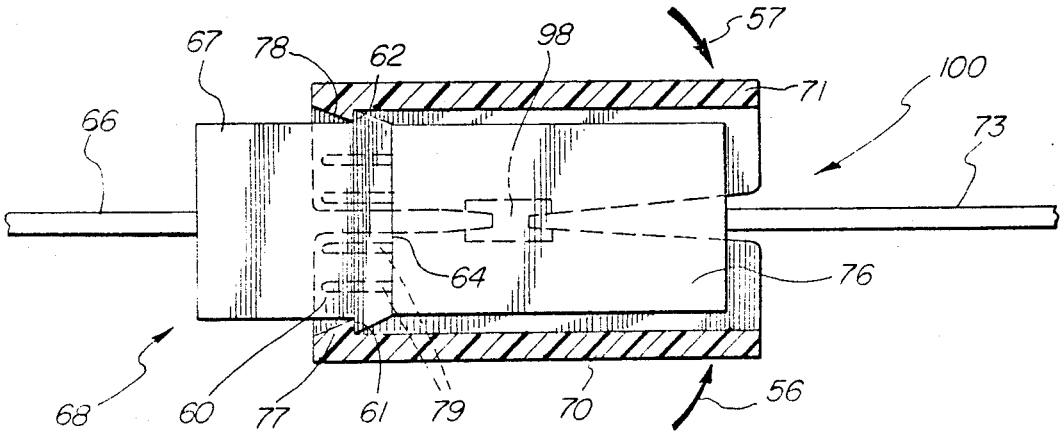
FIG. 8 is a section view of the alternate embodiment of FIG. 7.

By way of further example of the flexibility and broad uses to which the present invention molded coupling may be applied, FIG. 7 sets forth a rectangular format embodiment of the present invention coupler adapated to provide the connect/disconnect functions of an electrical system. A coupler generally referenced by reference number 100 comprises a generally rectangular formatted coupler formed by a pair of clamp members 70 and 71 each having generally U-shaped cross-sections and mutually joined at a pair of hinger 97 and 98 (the latter shown in FIG. 8). Coupler 100 further defines a generally rectangular opening 72 while clamp members 70 and 71 define a pair of elongated inwardly extending clasp ribs 77 and 78 respectively. An inner sleeve 76, the structure of which is set forth more clearly in FIG. 8, is configured in substantially the same rectangular shape as the combination of clamp members 70 and 71 and is supported within opening 72 of coupler 100 by the actions of hinges 97 and 98 in substantially the same manner as inner sleeve 26 is supported within half sleeve 11 and 12 by hinges 16 and 17 in the foregoing described coupler 10. In essence, coupler 100 comprises a rectangular version of coupler 10 in which a rectangular shape is substituted for the cylindrical shapes of half sleeves 11 and 12 and inner sleeve 26. Coupler 100 is in essence a rectangular version of coupler 10. In contrast to coupler 10 however, coupler 100 is configured to supply the connect/disconnect function of an electrical system rather than a fluid or gas system to which coupler 10 is directed. It will be apparent to those skilled in the art however that coupler 10 may be configured in a rectangular format and utilized in a fluid coupling system and that coupler 100 may be configured in a cylindrical format and provide an inner connection function of an electrical system. Accordingly, inner sleeve 76 defines an end surface 74 from which a plurality of connector elements 79 extend in a substantially parallel arrangement. In accordance with presently utilized electrical connector fabrication techniques, connector elements 79 are electrically and conductively coupled to the end portions of a plurality of wires 73 to provide a plurality of continuous electrical connections between connector elements 79 and wires 73.

A plug element 68 comprising a generally rectangular housing 67 is electrically coupled to a second plurality of wires 66 in accordance with generally known electrical connector fabrication techniques. The details of electrical connection between wires 66 and a plurality of connector elements supported within housing 67 (shown in FIG. 8) are not shown in detail but should be understood to comprise any of the presently available female connector constructions known and utilized in the art. In accordance with generally accepted electrical connector fabrication techniques, a plurality of female connector elements 60 are supported within housing 67 and positioned such that they receive connector elements 79 of coupler 100 when plug 68 is received within coupler 100 as set forth below in FIG. 8. Plug 68 further defines a pair of tapered clasp ribs 61 and 62 and and end surface 64. End surface 64 is not shown in detail but should be understood to comprise a generally planar surface within which connector elements 60 are formed to receive connector elements 79 when plug 68 is received within coupler 100 as shown in FIG. 8.

In the same functional manner as set forth above for coupler 10, plug 68 is coupled to coupler 100 by forcing plug 68 through opening 72 such that clasp ribs 61 and 62 are forced against clasp ribs 77 and 78 of coupler 100 respectively whereby clamp members 70 and 71 are pivoted about hinges 97 and 98 extending opening 72 and permitting plug 68 to be received therein. During the insertion of plug 68 and in accordance with generally accepted fabrication techniques, connector elements 79 are received within connector elements 60 and the electrical connections between wires 73 and wires 66 is accomplished.

FIG. 8 shows the assembled or coupled position of plug 68 within coupler 100 such that clasp ribs 61 and 62 of plug 68 are captivated within clasp ribs 77 and 78 respectively of clamp members 70. and 71. The operation of coupler 100 is, as mentioned above, substantially identical to that described for coupler 10 above. Accordingly, plug 68 may be released from coupler 100 by driving clamp members 70 and 71 inwardly in the direction shown by arrows 56 and 57 thereby pivoting clamp members 70 and 71 about hinges 97 and 98 and pulling clasp ribs 77 and 78 outwardly and out of engagement from clasp ribs 61 and 62 of plus 68. In the foregoing described operation of coupler 100, it will be apparent to those skilled in the art that, with respect to the present invention and in accordance therewith, the operation of hinges 97 and 98 is substantially identical to the operation of hinges 16 and 17 of coupler 10. Accordingly, hinges 97 and 98, as well as inner sleeve 76 and clamp members 70 and 71, are molded from a single integral member formed in a single step molding process. In accordance with the invention, hinges 97 and 98 are elastically deformed during the connecting and disconnecting process to provide a restoring process which maintains coupling to plug 68 without the use of additional springs or clamping members.

What has been shown is an efficient, inexpensive and easy to fabricate molded coupling in which a single molded member is provided without additional assembly and in which a novel elastically deformable integral hinge is provided which simultaneously provides a pivotal attachment between coupler members and a restoring force to secure coupling engagement.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the present invention.

That which is claimed is:

1. A one piece molded coupler for providing a removeable connection between two elements of a system, said molded coupler comprising:

a center sleeve defining a first end configured to be joined to one of said system elements;

a pair of half sleeves generally conformed to and spaced from said center sleeve in a surrounding relationship, said half sleeves defining first and second clasp means; and a pair of resilient hinge members coupled between said half sleeves and said center sleeve to permit said half sleeves to be pivotally attached to said center sleeve in a closed position, said resilient hinge members being elastically deformed by pivoting motion of said half sleeves with respect to said center sleeve to an open position and providing a restoring spring force to return said half sleeves to said closed position.

2. A one piece molded coupler as set forth in claim 1 wherein said center sleeve is cylindrical and wherein said half sleeves are generally semi-cylindrical.

3. A one piece molded coupler as set forth in claim 2 wherein said resilient hinge members each include a generally H-shaped member joined to said center sleeve and defining first and second lateral elements and a central transverse element said first lateral element being joined to one of said half sleeves and said second lateral element being joined to the other half sleeve.

4. A one piece molded coupler as set forth in claim 3 in combination with a fitting conformed to be joined to said center sleeve and defining lock means for cooperating with said first and second clasp means to lock said fitting to said center sleeve.

5. A one piece molded coupler as set forth in claim 4 wherein said first and second clasp means each define an inwardly extending rib having an inclined surface and an edge surface and wherein said lock means includes an annular ring defining a tapered surface and a lip surface, said edge surfaces grasping said lip surface in said closed position of said half sleeves.

6. A one piece molded coupler as set forth in claim 5 wherein said fitting is configured to be joined to said second element of said system.

7. A one piece molded coupler comprising;

a cylindrical center sleeve having an exterior surface and first and second ends;

a first half sleeve defining a semi-cylindrical shape and sized to overlay a first portion of said exterior surface of said center sleeve;

a second half sleeve defining a semi-cylindrical shape and sized to overlay a second portion of said exterior surface of said center sleeve; and elastic hinge means resiliently joining said first and second half sleeves to said exterior surface of said center sleeve in a spaced apart relationship.

8. A molded coupler as set forth in claim 7 wherein said hinge means include:

a first H-shaped hinge member having first and second lateral portions and a first transverse portion therebetween each joined to said exterior surface, said first and second half sleeves being joined to said first and second lateral portions respectively; and a second H-shaped hinge member having third and fourth lateral portions and a second transverse portion therebetween each joined to said exterior surface, said first and second half sleeves being joined to said third and fourth lateral portions respectively.

9. A molded coupler as set forth in claim 8 wherein said first and second half sleeves each define inwardly facing clasp members.

10. A molded coupler as set forth in claim 9 in combination with a fitting having an extension sized to be received between said first and second half sleeves and lock means cooperating with said clasp members to join said fitting to said molded coupler.

11. A molded coupler as set forth in claim 10 wherein said center sleeve defines a first central passage extending through it and wherein said fitting defines a second central passage extending through it, said first and second center passages forming a continuous passage when said fitting is joined to said molded coupler.

12. A molded coupler as set forth in claim 10 wherein said coupler supports a first plurality of electrical connectors and wherein said fitting supports a second plurality of electrical connectors, said first and second electrical connectors forming a plurality of electrical connections when said fitting is joined to said molded coupler.

13. A one piece molded coupler comprising;

a rectangular center sleeve having an exterior surface and first and second ends;

a first half sleeve defining a semi-rectangular shape and sized to overlay a first portion of said exterior surface of said center sleeve;

a second half sleeve defining a semi-rectangular shape and sized to overlay a second portion of said exterior surface of said center sleeve; and elastic hinge means resiliently joining said first and second half sleeves to said exterior surface of said center sleeve in a spaced apart relationship.

14. A molded coupler as set forth in claim 13 wherein said hinge means include:

a first H-shaped hinge member having first and second lateral portions and a first transverse portion therebetween each joined to said exterior surface, said first and second half sleeves being joined to said first and second lateral portions respectively; and a second H-shaped hinge member having third and fourth lateral portions and a second transverse portion therebetween each joined to said exterior surface, said first and second half sleeves being joined to said third and fourth lateral portions respectively.

15. A molded coupler as set forth in claim 14 wherein said first and second half sleeves each define inwardly facing clasp members.

16. A molded coupler as set forth in claim 15 in combination with a fitting having an extension sized to be received between said first and second half sleeves and lock means cooperating with said clasp members to join said fitting to said molded coupler.

17. A molded coupler as set forth in claim 16 wherein said center sleeve defines a first central passage extending through it and wherein said fitting defines a second central passage extending through it, said first and second center passages forming a continuous passage when said fitting is joined to said molded coupler.

18. A molded coupler as set forth in claim 16 wherein said coupler supports a first plurality of electrical connectors and wherein said fitting supports a second plurality of electrical connectors, said first and second electrical connectors forming a plurality of electrical connections when said fitting is joined to said molded coupler.

* * * * *